US006620085B2

(12) United States Patent
Gambetti

(10) Patent No.: US 6,620,085 B2
(45) Date of Patent: Sep. 16, 2003

(54) SYSTEM FOR TRANSFERRING CARDBOARD BLANKS IN INDIVIDUAL SUCCESSION

(75) Inventor: Mario Gambetti, Bologna (IT)

(73) Assignee: Baumer S.r.l., Castelfranco Emilia (Modena) (IT)

( * ) Notice: Subject to any disclaimer, the term of this patent is extended or adjusted under 35 U.S.C. 154(b) by 0 days.

(21) Appl. No.: 09/808,236

(22) Filed: Mar. 14, 2001

(65) Prior Publication Data

US 2001/0023227 A1 Sep. 20, 2001

(30) Foreign Application Priority Data

Mar. 15, 2000 (IT) ..... BO2000A0137

(51) Int. Cl.[7] ..... B31B 1/02

(52) U.S. Cl. ..... 493/71; 493/81; 493/125; 493/147; 493/180

(58) Field of Search ..... 493/71, 81, 125, 493/147, 180, 196, 201, 101, 123; 271/31.1, 98, 107, 150, 12, 270, 902; 414/737

(56) References Cited

U.S. PATENT DOCUMENTS 2,936,681 A * 5/1960 Earp
4,518,301 A * 5/1985 Greenwell
4,697,973 A 10/1987 Hahn et al.
4,896,873 A * 1/1990 Saro ..... 271/12
5,029,834 A * 7/1991 Boldrini et al.
5,078,669 A * 1/1992 Dietrich et al. ..... 493/123
5,080,341 A * 1/1992 Liithy ..... 271/12
5,385,526 A * 1/1995 Sigrist et al. ..... 493/123
5,445,370 A * 8/1995 Soga ..... 271/12

FOREIGN PATENT DOCUMENTS

DE 44 39 723 5/1996
EP 0 949 148 10/1999

* cited by examiner

*Primary Examiner*—Eugene Kim
*Assistant Examiner*—Sameh Tawfik
(74) *Attorney, Agent, or Firm*—Herbert Dubno

(57) ABSTRACT

A method for transferring cardboard blanks (7) in individual succession in a plant, comprising a store (1) for collection of cardboard blanks (7*b*), a conveyor (3), with an upstream portion (3*a*) which is designed to receive the cardboard blanks (7*a*), and a rotary collector-translator (2), comprising one or a plurality of orbiting gripper units (100, 200), wherein the cardboard blank is grasped in the store (1), extracted, translated and spaced, whilst being kept substantially parallel to the successive cardboard blank (7*c*), which is still disposed in the vicinity of the downstream end (1*a*) of the store (1); and is then inclined, and placed parallel on the upstream portion (3*a*) of the conveyor (3). A corresponding system, and a corresponding rotary collector-translator.

14 Claims, 7 Drawing Sheets

1
2
3
4
5
6b
7
20b
20a
21
23
24a
25
26
27
28
29
30a
30b
31
32a
32b
33a
33b
34a
34b
100
101
102
103
104
106
107
108
109
110a
110b
110c
110d
110e
111a
111b
111c
111d
111e
124a
124b
200
201
202
203
204
205
206
207
208
209
210a
210b
210c
210d
210e
211a
211b
211c
211d
211e
224a
224b
301
701
702
703
704
X2
Y1
Y3
Y7

1
2
3
4
5
7
7a
7b
8
9
10
11a
12a
13
14a
15a
6a
Y1
Y3
Y7
1a
F1
100
101
102
103
104
105
106
107,108
109
110
111
200
201
202
203
204
205
206
207,208
209
210
211
22
23
23a
23b
23c
23d
x2
3a
34a, 34b
30a, 30b
20a, 20b
301
703

SYSTEM FOR TRANSFERRING CARDBOARD BLANKS IN INDIVIDUAL SUCCESSION

FIELD OF THE INVENTION

The present invention relates to a method of and a system for transferring cardboard blanks.

BACKGROUND OF THE INVENTION

At present, with particular reference to the field of packaging and/or wrapping machines, various systems for transferring cardboard blanks are known, but these systems are substantially unable to collect and supply at high speed flat cardboard blanks with large dimensions.

OBJECT OF THE INVENTION

The object of the present invention is to eliminate the above-described disadvantage.

SUMMARY OF THE INVENTION

The invention accomplishes the object with:

a store for collection of cardboard blanks, which extends longitudinally along its own longitudinal axis, and is designed to present in the vicinity of its downstream end the cardboard blanks to be transferred;

a conveyor, which extends longitudinally along its own longitudinal axis, which is aligned with the axis of the store, wherein the upstream portion of the said conveyor is designed to receive the cardboard blanks;

a rotary collector-translator, which is designed to rotate relative to an axis perpendicular to the axes of the store and of the conveyor, and is disposed between the downstream end of the said store and the upstream portion of the said conveyor, and comprises one or a plurality of orbiting gripper units, which are designed to collect the cardboard blanks in succession from the downstream end of the store, and then to deliver them onto the upstream portion of the conveyor.

The transfer of each individual cardboard blank comprises the following operations: a)-gripping of the cardboard blank at the downstream end of the store; b)-extraction of the cardboard blank from the downstream end of the store; c)-translation of the cardboard blank towards the axis of rotation of the rotary collector-translator, whilst keeping the said cardboard blank substantially parallel relative to the successive cardboard blank, which is still disposed in the vicinity of the downstream end of the store; d)-spacing the cardboard blank which is being translated, from the successive cardboard blank, which is still disposed in the vicinity of the downstream end of the store, while keeping the said cardboard blank which is being translated substantially parallel to the successive cardboard blank, which is still disposed in the vicinity of the downstream end of the store; e)-inclining the cardboard blank which is being displaced, while moving its front portion towards and above the upstream portion of the conveyor; f)-placing at least this front portion of the cardboard blank which is being displaced, parallel to and above, and in contact with, the upstream portion of the conveyor.

Each of the orbiting gripper units comprises one or a plurality of suckers, which are controlled so as to move in respective orbital paths, which are disposed in respective planes perpendicular to the axis of rotation of the said rotary collector-translator. The upstream portion of the conveyor extends within the operative context of the orbital path of the suckers. In the execution of their orbital paths, the suckers pass adjacent to the upstream portion of the conveyor.

A rotary collector-translator is thus provided with orbiting gripper units, which are circumferentially equally spaced, and wherein the rotary collector-translator has;

an orbiting and oscillating shaft, which is supported so as to be rotated by, and between, two rotary elements, in the vicinity of their radial periphery, is oriented parallel to the said axis of rotation of the rotary collector-translator, and is designed to orbit along a circular path. One or a plurality of arms, which on the collector translator can be inclined in respective planes which are perpendicular to the axis of rotation, and have one end which is secured to the said orbiting and oscillating shaft, and the opposite end which is designed to support respective orbiting suckers. A first toothed wheel is keyed onto the said orbiting and oscillating shaft, a second toothed wheel is supported to rotate adjacent to the said first toothed wheel, by means of a pin which projects axially from one of the said rotary elements and a toothed belt is wound around the first toothed wheel and around the second toothed wheel. A lever, has a first end secured to the second toothed wheel, and an opposite, or second, end designed to support in an idle rotary manner a cam-follower roller, the cam-follower rollers of each orbiting gripper unit being designed to follow the profile of a common stationary cam.

A first advantage of the present invention is that it is possible to transfer at high speed cardboard blanks which have large dimensions, with a consequent increase in the production capacity of the corresponding packaging machines.

A further advantage of the present invention is that the said transfer at high speed takes place by means of positive translation, wherein, substantially, the cardboard blanks are always firmly grasped by the operative means, with consequent reduction of possible jamming caused by malfunctioning.

Further characteristics and advantages of the present invention will become more apparent from the following description of a preferred practical embodiment, provided here purely by way of non-limiting example, with reference to the figures in the accompanying drawing.

DETAILED DESCRIPTION

Figure 1:
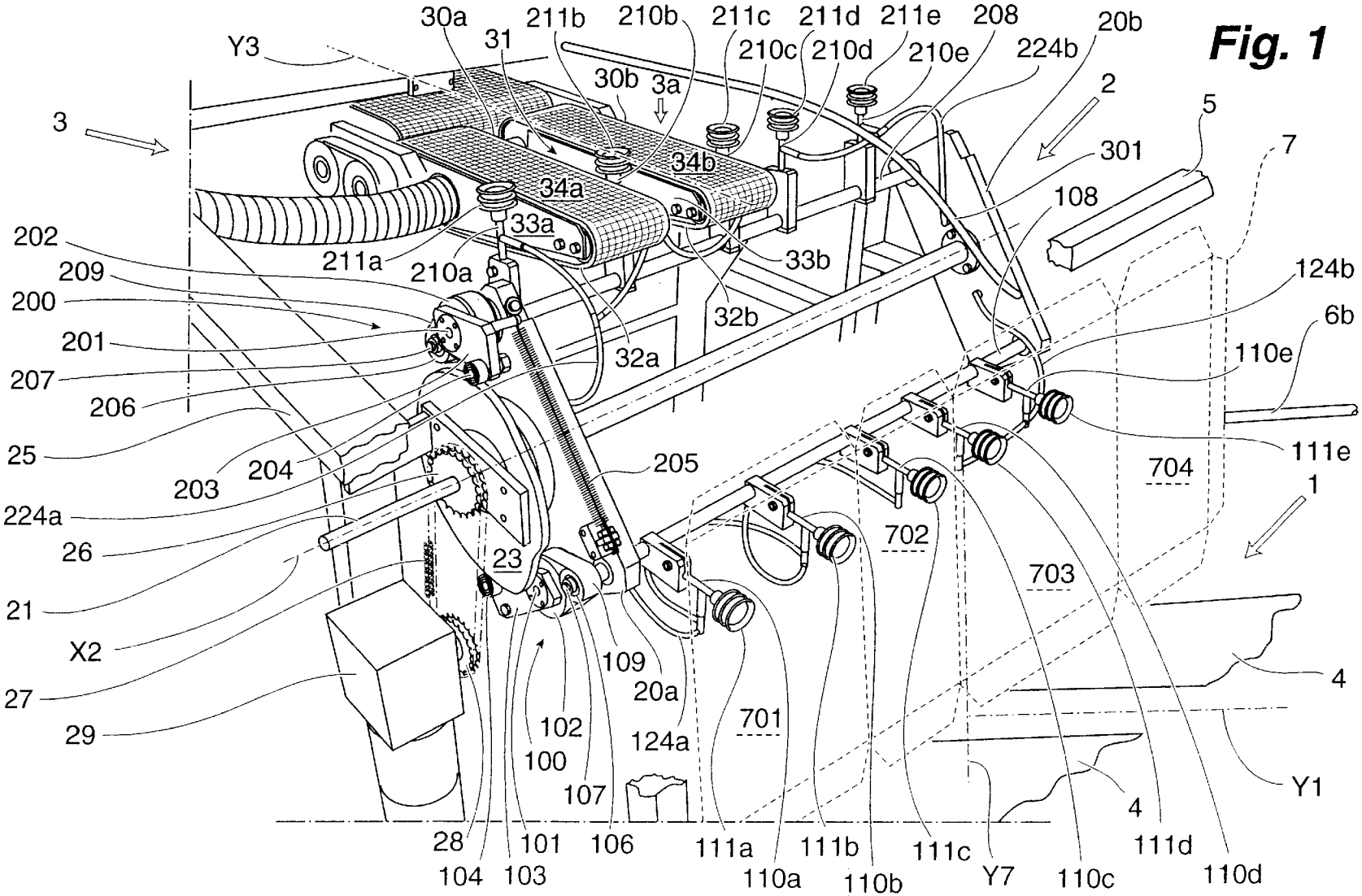
FIG. 1 is a detailed, perspective, schematic view of the present invention.
Figure 2:
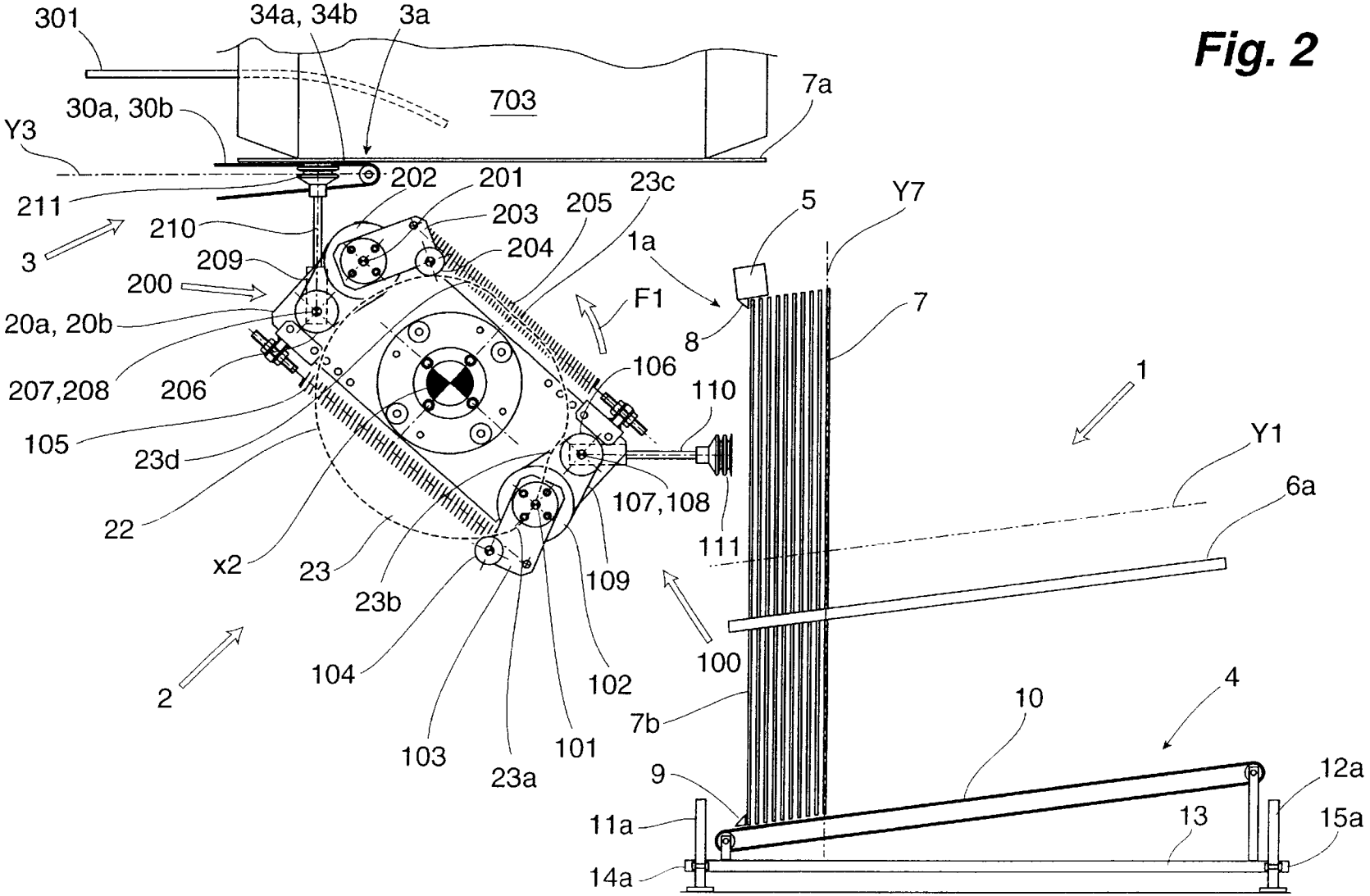
FIG. 2 is a lateral schematic view of the method and the system which are the subject of the present invention, according to a first operative configuration.

With reference to FIGS. 1 and 2, the system which is the subject of the present invention substantially comprises a store 1, a rotary collector-translator 2, and a receiver conveyor 3.

Store

The store 1 extends longitudinally along an axis Y1 and comprises a bed 4 which is inclined longitudinally from upstream towards downstream, and from top to bottom, an upper cross member which is disposed downstream, and lateral guides 6*a* and 6*b*, in order to constitute a tray, which is designed to carry, vertically and supported sideways, a plurality of cardboard blanks 7, each of which extends along a longitudinal-vertical supply axis Y7, wherein, in the vicinity of the downstream end la of the store 1, the cardboard blanks 7 are retained by means of a plurality of stop teeth, indicated as 8 and 9.

Preferably, the collection bed 4 consists of a conveyor 10, which is designed to advance the cardboard blanks 7 in the downstream direction. The conveyor 10 can be actuated by means of an electric servomotor, and in this case a phase and speed control servomotor, such as a brushless servomotor.

The said store 1 is supported at the base and suspended, by means of a rectangular tubular frame 13, which in turn is supported by four legs disposed in the vicinity of the corresponding four vertices, wherein only two legs 11*a* and 12*a* can be seen in FIG. 2, whereas the other two legs are arranged in mirror image on the other side of the store 1.

Each of the said four legs 11*a* and 12*a*, and the other two on the other side have respective lifting means 14*a*, 15*a*, and another two on the other side, such as a scroll which extends vertically, can be rotated by command, and engages with a screw nut which is secured to the four vertices of the said rectangular frame 13, in order to be able to raise or lower the store 1.

Collector-translator

Between the downstream end of the store 1, and the upstream portion of the conveyor 3, there is disposed the rotary collector-translator 2 which is designed to rotate around an axis X2 and which has two separate orbiting gripper units, indicated as 100 and 200 as a whole.

Each of the said orbiting gripper units 100 and 200 comprises a respective plurality of suckers 111 and 211, indicated individually as 111*a*, 111*b*, 111*c*, 111*d*, 111*e* and 211*a*, 211*b*, 211*c*, 211*d*, 211*e*, wherein a first series of suckers 111*a*, 111*b*, 111*c*, and 211*a*, 211*b*, 211*c*, is controlled by means of respective pneumatic distribution 124*a* and 224*a*, whereas a second series of suckers 111*d*, 111*e* and 211*d*, 211*e* is controlled by means of respective second pneumatic distribution 124*b* and 224*b*.

The respective suckers 111 and 211 of each orbiting gripper unit 100 and 200 are supported on a first end of respective arms 110 and 210, indicated individually as 110*a*, 10*b*, 110*c*, 110*d*, 10*e*, and 210*a*, 210*b*, 210*c*, 210*d*, 210*e*, which have their opposite or second ends secured to respective orbiting and oscillating shafts 108 and 208, which are supported such as to be rotated by means of two rotary elements 20*a* and 20*b*, which are disposed opposite one another, spaced, and keyed onto a common shaft 21, which is designed to rotate on the axis X2 of the said rotary collector-translator 2, such as to incline the said arms 110*a*–210*a*, 110*b*–210*b*, 110*c*–210*c*, etc, in respective planes which are perpendicular to the said axis of rotation X2, in phase ratio during rotation of the said rotary collector-translator 2, as described in greater detail hereinafter.

The shaft 21 has its opposite end supported by the frame 25 of the machine, and, to enable it to be driven, has keyed onto it a toothed wheel 26, around which there is wound a chain 27, which is also wound around a toothed wheel 28, wherein the latter is rotated by means of an electric servomotor 29, in this case a phase and speed control servomotor, such as a brushless servomotor.

Each of the said orbiting shafts 108 and 208 has respective end portions 107 and 207, which extend beyond the rotary element 20*a*, in order to support, keyed onto them, respective first toothed wheels 106 and 206, around which there are wound respective toothed belts 109 and 209, which are also wound around respective second toothed wheels 102 and 202, disposed adjacent to the respective first toothed wheels, 106 and 206, wherein the said second toothed wheels 102 and 202 are supported such as to rotate in an idle manner, by means of respective pins 101 and 201, which are supported such as to project axially towards the exterior, by the said rotary element 20*a*.

The second toothed wheels 102 and 202 support integrally the first ends of respective levers 103 and 203, the opposite or second ends of which support such as to rotate in an idle manner respective cam-follower rollers 104 and 204, wherein, in operation, as described in greater detail hereinafter, the latter are designed to follow the profile 22 of a common stationary disc cam 23, which is supported by, and secured to, the machine frame 25.

In order to keep the respective cam-follower rollers 104 and 204 pressed against the profile 22 of the cam 23, respective return springs 105 and 205 are provided, which are subjected to traction, and have their respective first ends secured to the second, free ends of the respective levers 103 and 203, and have their opposite ends secured to the rotary element 20*a*.

As will become more apparent hereinafter, by means of this structuring, during the rotation of the two opposite elements 20*a*–20*b*, the respective suction suckers 111*a*, 111*b*, 111*c*, 111*d*, 111*e* and 211*a*, 211*b*, 211*c*, 211*d*, 211*e* of each orbiting gripper unit are moved along respective orbital paths disposed in respective planes, which are perpendicular to the axis of rotation X2, and, additionally, whilst the said paths are being followed, the gripping plane which is configured by the said suckers 111 and 211 assumes different orientations, which are determined by the profile 22 of the stationary cam 23, on which the respective cam followers 104 and 204 run.

Receiver Conveyor

The receiver conveyor 3 extends longitudinally along the longitudinal axis Y3, and has a upstream portion 3*a*, which is designed to receive and grasp the cardboard blanks 7 which are presented by the collector-translator 2, wherein the upstream portion 3*a* extends within the operative scope of the orbital path of the suckers 111 and 211.

More particularly, the conveyor 3 preferably comprises two suction transporters 30*a* and 30*b*, which extend longitudinally and which form the upstream portion 3*a* of the conveyor 3, wherein the said upstream portion 3*a* extends without interfering, within the operative scope of the orbital path of the suction suckers 111 and 211.

The two suction transporters 30*a* and 30*b* have a predetermined transverse amplitude, in order not to interfere with the orbital path of the suckers 111*a*–211*a* and 111*c*–211*c*, which pass in the vicinity of the opposite sides of the said upstream portion 3*a*, and, more particularly, respectively in the vicinity of the outer side of the transporter 30*a*, and in the vicinity of the outer side of the transporter 30*b*.

The two transporters 30*a* and 30*b* are also transversely spaced from one another, in order to create an aperture 31, which is aligned with the plane in which the suction suckers 111*b* and 211*b* orbit, wherein the said aperture has an amplitude such as to permit passage, without interfering with the motion of the suction suckers 111*b* and 211*b*.

However, in this context, it should be pointed out that the said upstream portion 3*a* of the conveyor 3 can be formed by a single transporter, such as the transporter 34*a* only, on the opposite sides of which the suckers 111*a*–211*a* and 111*b*–211*b* pass freely, or, preferably, by two separate transporters 30*a* and 30*b*, between which there is provided an aperture 31 for passage of the suckers 111*b*–211*b*, or, similarly and equivalently, by a plurality of transporters provided with a plurality of apertures for free passage of a plurality of suckers.

Each of the said transporters 30*a* and 30*b* comprises respective conveyor belts 32*a* and 32*b* of the porous type, which are wound around a closed path on respective supports 33*a* and 33*b*, wherein the latter have in their interior a duct which is open at the top, and is connected by means of tubes to a suction source, not illustrated, in order to create suction on the upper branch 34*a* and 34*b* of each of the said transporters 30*a* and 30*b*.

The said conveyor 3 is preferably actuated by means of an electric servomotor, and in this particular case a phase and speed control servomotor, such as a brushless servomotor.

The above-described system also has means for mechanical and/or electrical and/or electronic synchronization and control, in order to synchronize the motion between the said store 1, the said rotary collector-supplier 2, and the said conveyor 3, and in order to control their correct functioning.

Functional Description

FIGS. 2 to 8 illustrate schematically in succession seven particular operative configurations assumed by the method and the system which both constitute the subject of the present invention, at 30° intervals of rotation of the rotary collector-translator 2, which during functioning rotates in the direction F1.

With reference to FIG. 2, the suckers 111 of the orbiting gripper unit 100, which have their gripping plane substantially parallel to the plane in which the cardboard blank 7*b* is disposed, prepare to come into contact with the cardboard blank 7*b* itself, which is disposed in the vicinity of the downstream end 1*a* of the store 1, whereas, in an opposite direction, the suckers 211 of the orbiting gripper unit 200, which have their gripping plane parallel to the receiver branch 34*a*–34*b* of the upstream portion 3*a* of the conveyor 3, prepare to deposit and release a preceding cardboard blank 7*a* onto the said upstream portion 3*a*.

Figure 3:
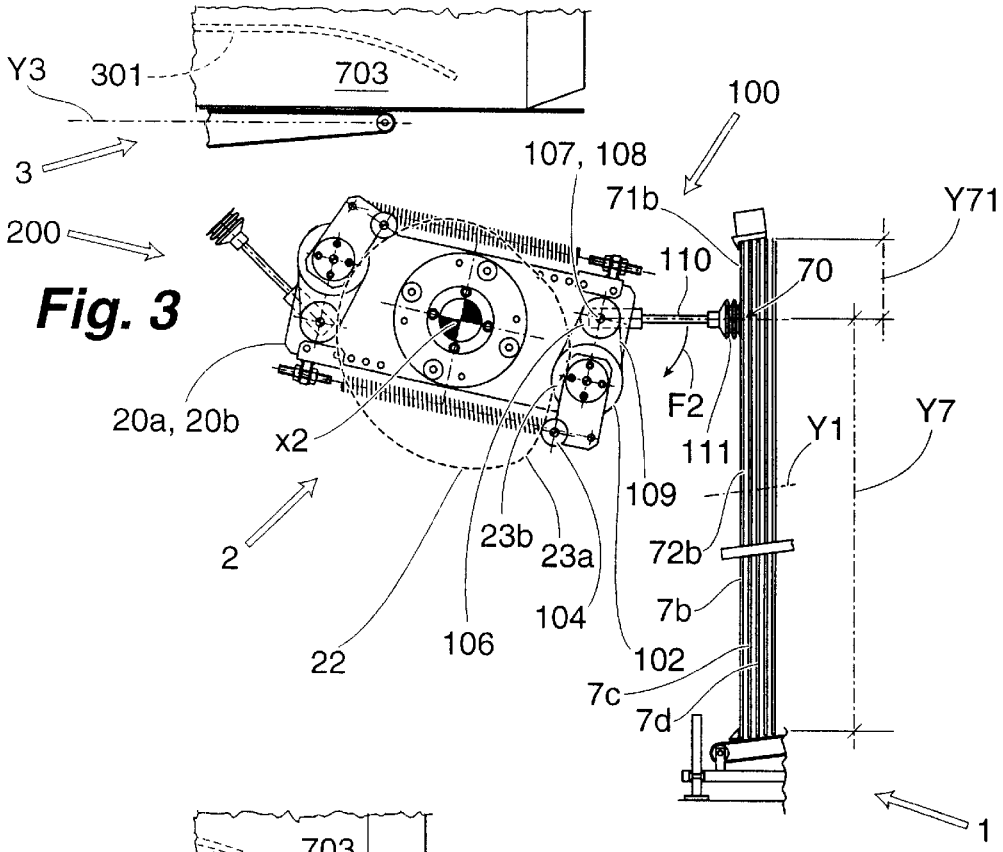
FIGS. 3, 4, 5, 6, 7 and 8 illustrate schematically seven operative configurations subsequent to that illustrated in FIG. 2.

With reference to FIG. 3, after the two rotary elements 20*a*–20*b* have rotated, the suckers 111 have come into contact with the cardboard blank 7*b* in a particular area 70 of its longitudinal extension Y7, thus giving rise to a front portion 71*b* of cardboard blank, and a rear portion 72*b* of cardboard blank.

Figure 4:
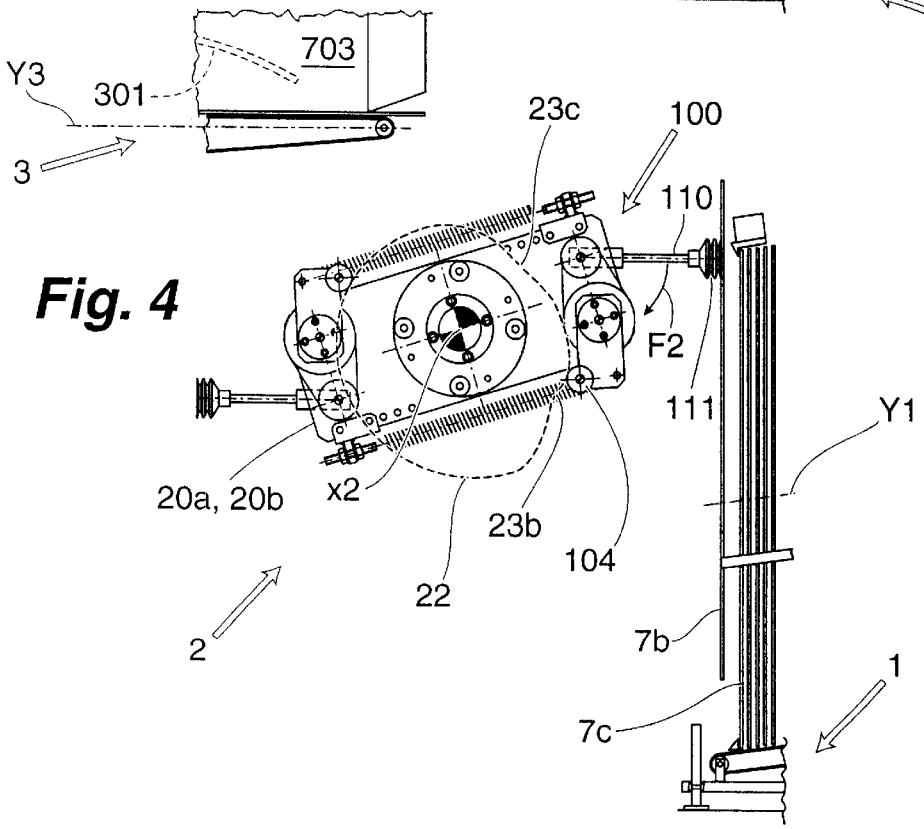

During the said step, the profile 22 of the stationary cam 23 on which the roller 104 runs, is displaced towards the center X2, see segment 23*a*–23*b*, such as to oscillate the second wheel 102 clockwise, and, by means of the belt 109, also the first wheel 106, with consequent similar oscillation of the orbiting shaft 107–108, and corresponding inclination, in the direction F2, of the arm 110, and of the corresponding sucker 111, thus generating relative movement between the rotary elements 20*a*–20*b* and the suckers 111, wherein the said relative movement is such as to create a halt in the orbital path of the suckers 111 (i.e. a halt of the upstream movement), wherein, substantially, during this halt, all the suckers 111, in which suction is created by means of the pneumatic distributors 124*a* and 124*b*, owing also to the circumferential orbital path followed by the orbiting and oscillating shaft 107–108, are firstly moved towards the cardboard blank 7*b*, and then towards the axis of rotation X2, see also FIG. 4, such as to come into contact with, grasp, and extract, the cardboard blank 7*b*, whilst keeping it substantially perpendicular to the other stacked cardboard blanks 7*c*, 7*d*, etc.

With reference to FIG. 4, after the two rotary elements 20*a*–20*b* have rotated, the suckers 111 have translated the cardboard blank 7*b* from the downstream end of the store 1 towards the center of rotation X2, and the profile 22 of the cam 23, which forms the path of the roller 104, is displaced further towards the center of rotation X2, see segment 23*b*–23*c*, such as to incline the arm 110 and the corresponding suckers 111 further in the direction F2, relative to the two rotary elements 20*a*–20*b*, in order to translate the cardboard blank 7*b* towards the center of rotation X2, and slightly upwards, still keeping it substantially parallel relative to the successive cardboard blank 7*c*.

Figure 5:
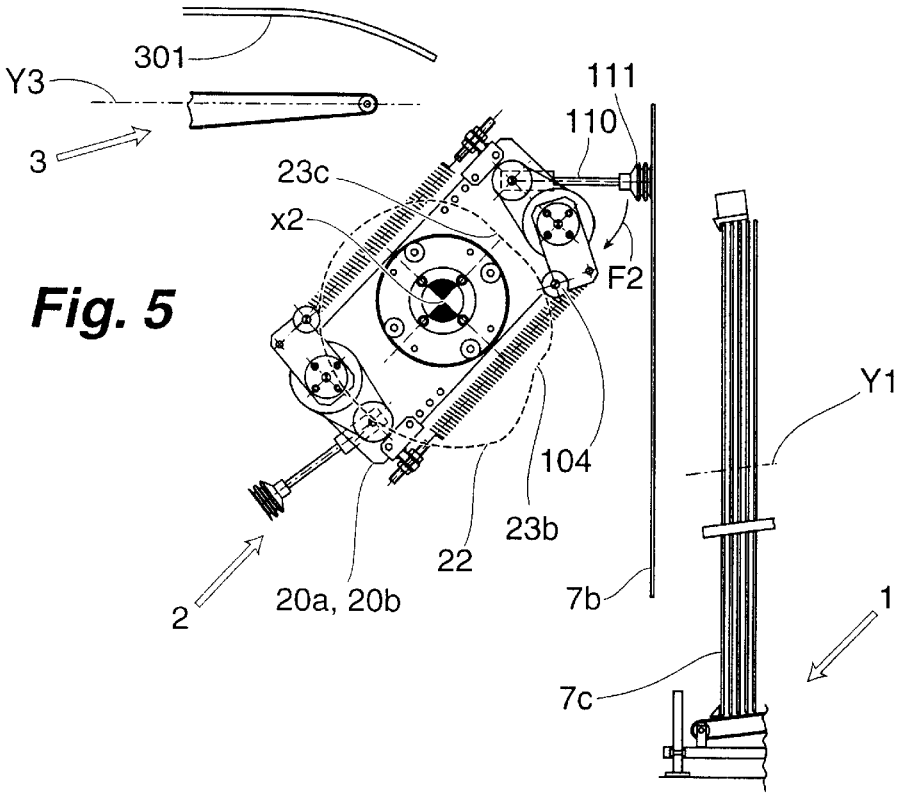

With reference to FIG. 5, after the two rotary elements 20*a*–20*b* have rotated, the suckers 111 have translated the cardboard blank 7*b* further towards the center of rotation X2 and upwards, and the profile 22 of the cam 23, which forms the path of the roller 104, is displaced further towards the center X2, again see segment 23*b*–23*c*, such as to incline the arm 110 and the corresponding suckers 111 further in the direction F2, relative to the two rotary elements 20*a*–20*b*, in order to translate the cardboard blank 7*b* towards the center of rotation X2, and slightly upwards, still keeping it substantially parallel relative to the successive cardboard blank 7*c*.

Figure 6:
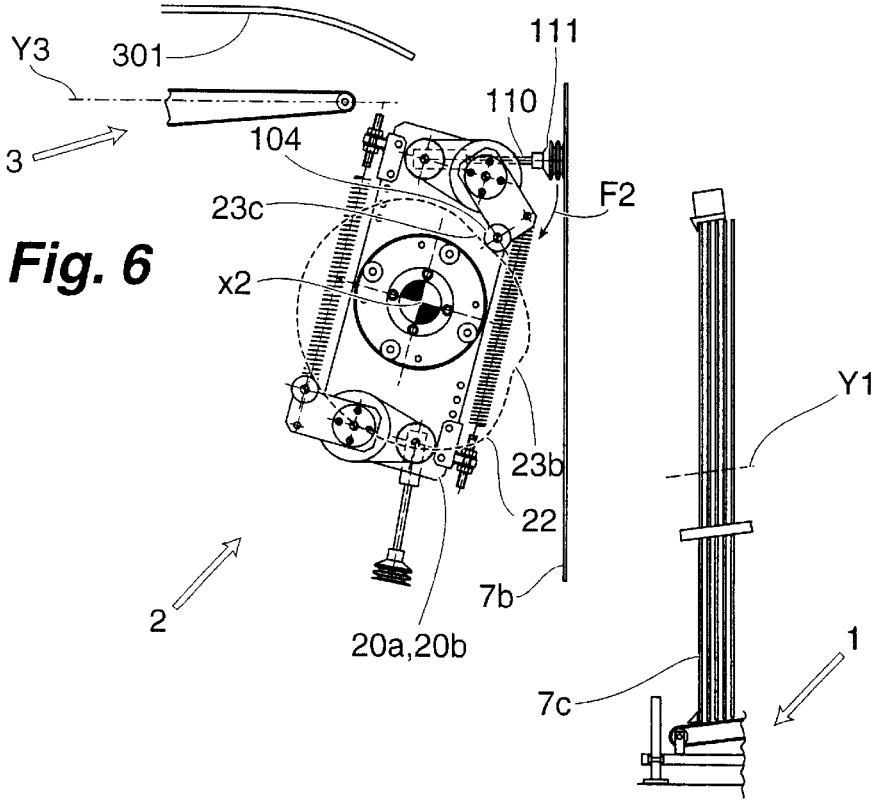

With reference to FIG. 6, after the two rotary elements 20*a*–20*b* have rotated, the suckers 111 have translated the cardboard blank 7*b* further towards the center of rotation X2 and upwards, and the profile 22 of the cam 23, which forms the path of the roller 104, is displaced further towards the center X2, again see segment 23*b*–23*c*, such as to incline the arm 110 and the corresponding suckers 111 further in the direction F2, relative to the two rotary elements 20*a*–20*b*, in order to translate the cardboard blank 7*b* towards the center of rotation X2, and slightly upwards, still keeping it substantially parallel relative to the successive cardboard blank 7*c*.

In this context, for the reasons which will become more apparent hereinafter, it must be emphasized that approximately 50% of the orbital path which is necessary in order for the orbiting and oscillating bars 108 and 208 to be able to execute the complete transfer cycle, i.e. a considerable percentage of the said cycle, has been used substantially to space the said cardboard blank 7*b* significantly from the successive cardboard blank 7*c*, thus keeping the said cardboard blank 7*b* which is being transferred parallel to the blanks 7*c* which are kept in the store 1.

In fact, with particular reference to the embodiment described here, in which complete transfer takes place after rotation of 180° by the rotary collector-translator 2, approximately 90° of the said rotation has been used to space the cardboard blank extracted from that which is still kept in the store 1, and, similarly, in the hypothesis of a rotary collector-translator which is provided with three collector-translator units which are disposed circumferentially equidistantly spaced by the 120° necessary in order to execute a complete transfer cycle, approximately 60° would have been used in order to space the cardboard blank extracted, from that which is still kept in the store.

Figure 7:
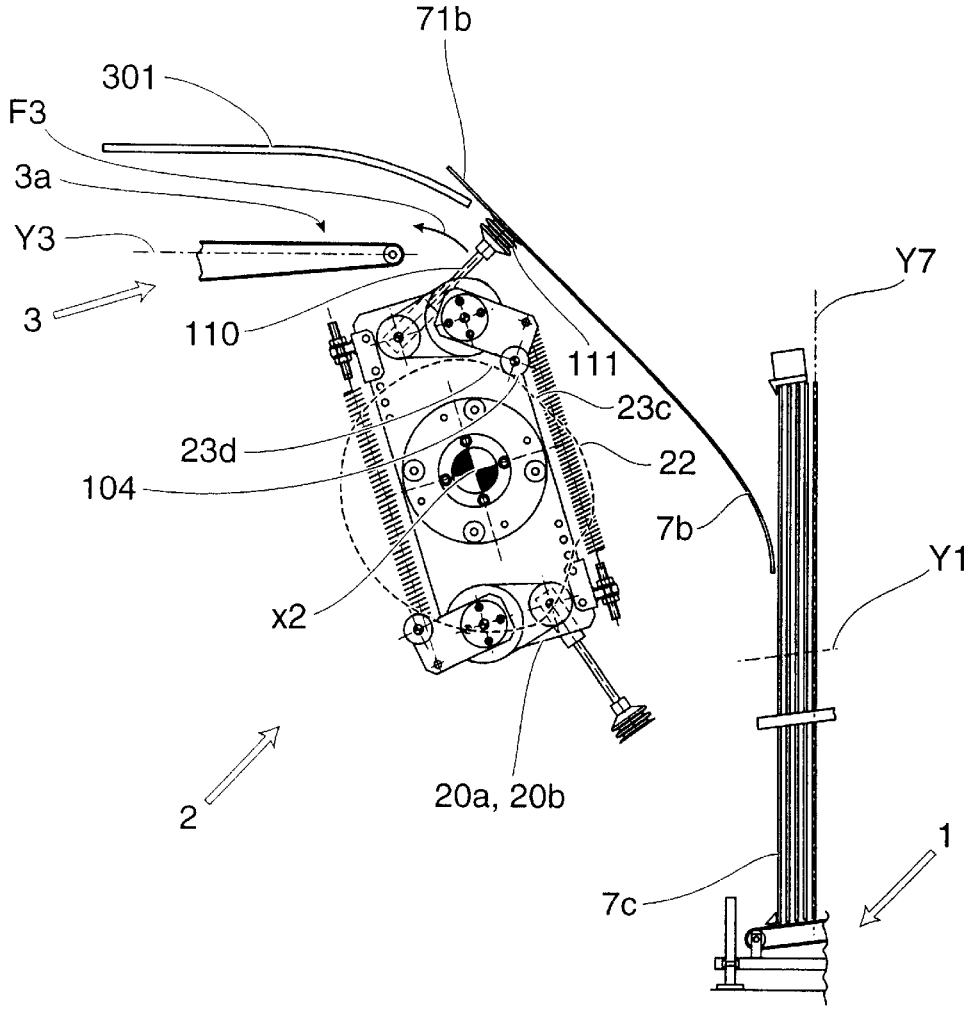

With reference to FIG. 7, after the two rotary elements 20*a*–20*b* have rotated, the suckers 111 have translated the cardboard blank 7*b* towards the upstream portion 3*a* of the conveyor 3 and upwards, and the profile 22 of the cam 23, which forms the path of the roller 104, is displaced towards the exterior, see the path 23*c*–23*d*, such as to incline the arm 110 and the corresponding sucker 111 in the direction F3 relative to the two rotary elements 20*a*–20*b*, in order to incline the cardboard blank 7*b* relative to its preceding position, and in order to direct the front portion 71*b* of the same cardboard blank 7*b* onto the upstream portion 3*a* of the conveyor 3.

In this context, as previously stated, it should be pointed out that, in the preceding operative steps, see FIGS. 3 to 6, having translated and spaced the cardboard blank 7*b* which is being translated, from the successive cardboard blank 7*c* which is kept in the store 1, still keeping the said cardboard blank 7*b* which is being translated parallel to the successive cardboard blank 7*c*, only a small portion of the tail of the cardboard blank 7*b* interferes with the successive cardboard blank 7*c*, and, again in this context, it should also be pointed out that the said minor interference is such as not to affect adversely the correct translation-inclination of the cardboard blank 7*b*.

In addition, the aforementioned minor interference occurs when use is made of cardboard blanks which have large dimensions in relation to their longitudinal axis of extension Y7, and thus, the said interference does not occur when use is made of cardboard blanks with smaller longitudinal dimensions, or when a rotary collector-translator 2 with larger dimensions (i.e. lager diameter) is used.

Figure 8:
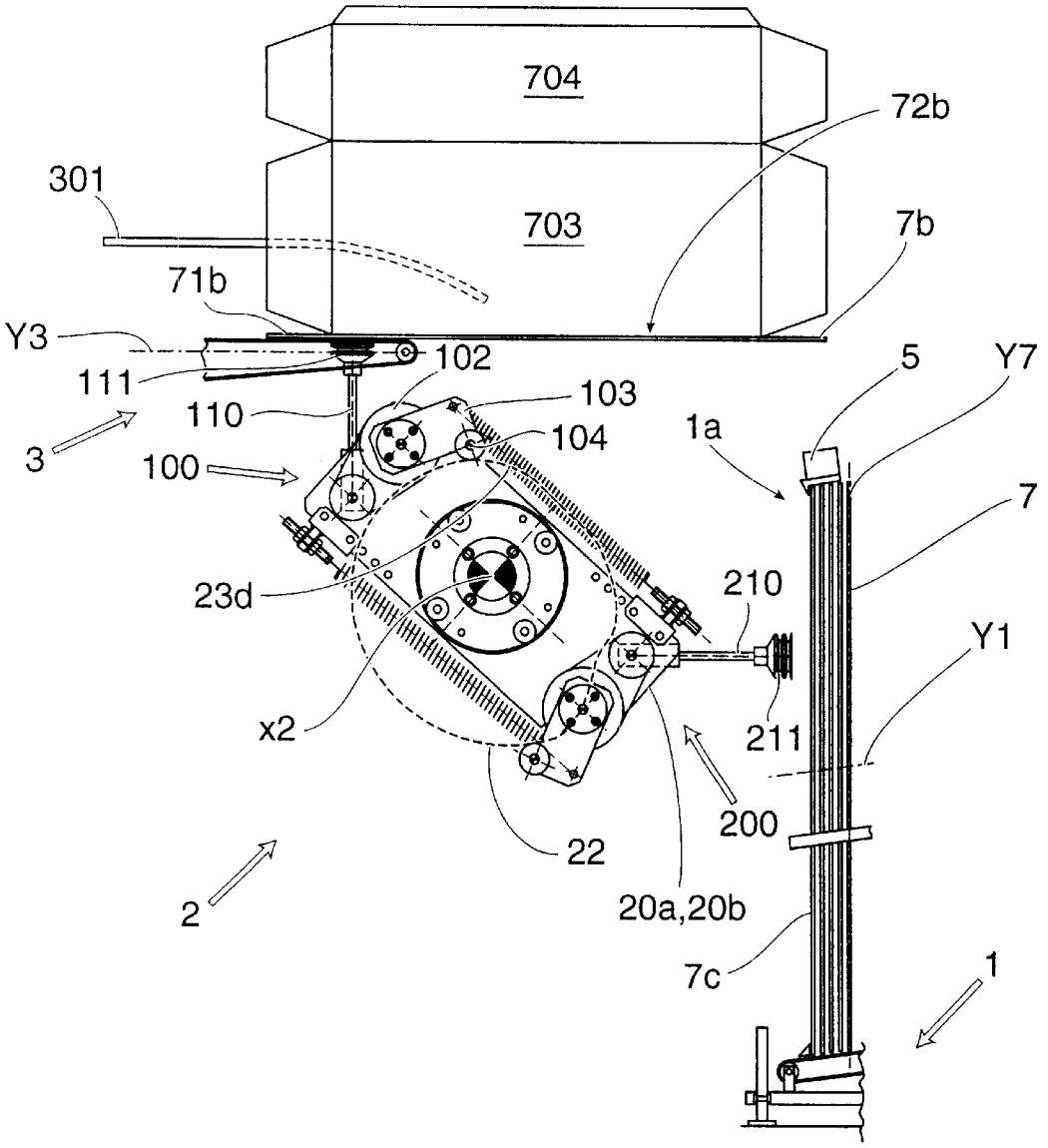
Figure 9:
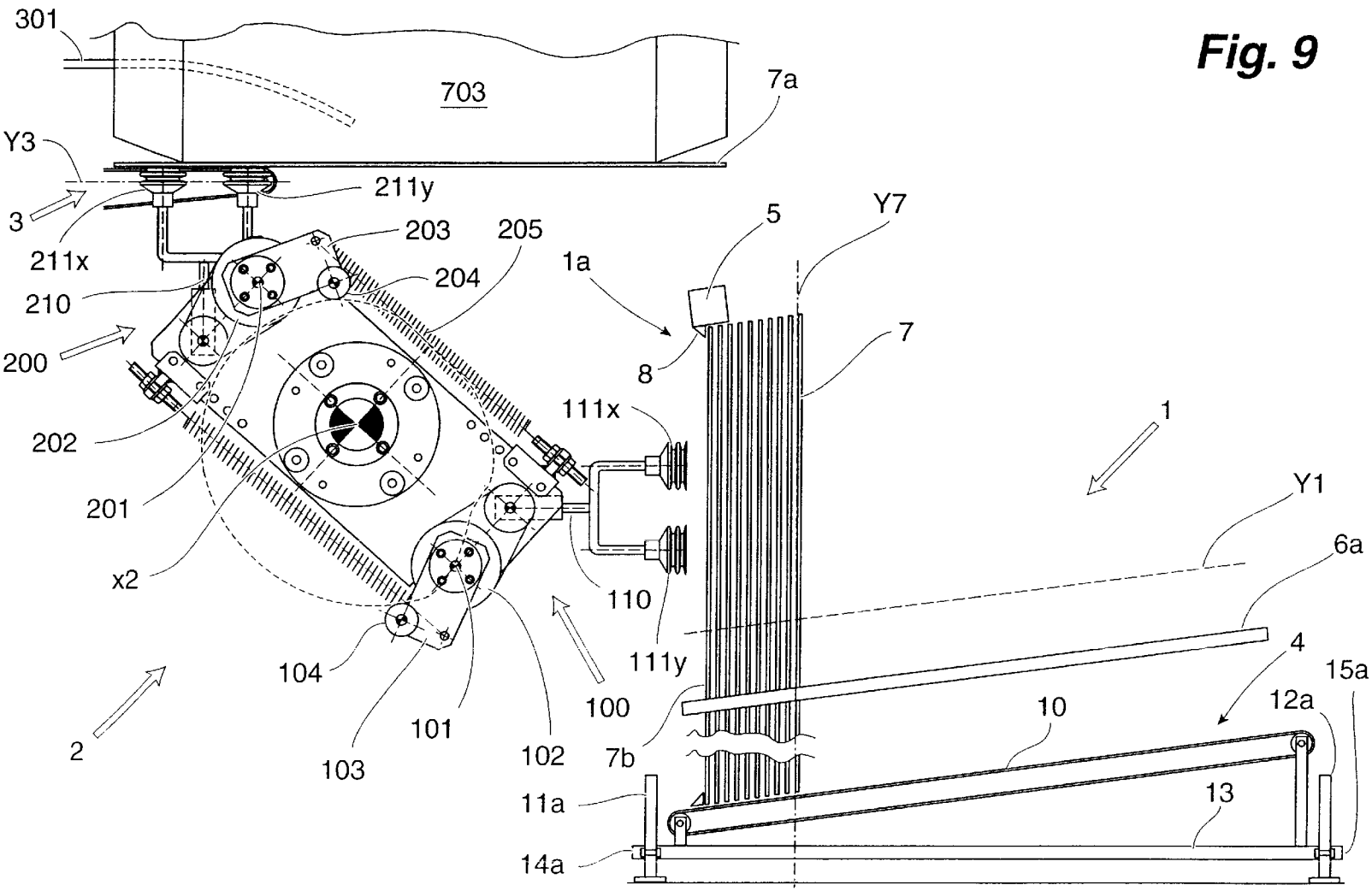
FIG. 9 is a lateral schematic view of the method and the system which are the subject of the present invention, according to a variant.

With reference to FIG. 8, after the two rotary elements 20*a*–20*b* have rotated, the suckers 111 have translated and inclined the cardboard blank 7*b* further until it is disposed parallel on the upstream portion 3*a* of the conveyor 3, and, more specifically, until at least the front portion 71*b* and a front part of the rear portion 72*b* are disposed parallel on the branches 34*a* and 34*b* of the two transporters 30*a* and 30*b*, wherein, in order to obtain this configuration, the sucker 111*b* is inserted between the said two transporters 30*a* and 30*b*, using the aperture 31, the sucker 111*a* is disposed on the outer side of the transporter 30*a*, and the sucker 111*c* is disposed on the outer side of the transporter 30*b*.

In order to obtain this configuration, the profile 22 of the cam 23, which forms the path of the roller 104, provides calibrated displacement, see the downstream path of the point 23*d*, which is designed to incline the arms 110 and the corresponding suckers 111 such that the gripping plane of the said suckers 111 is parallel to the upper receiver plane 34*a* and 34*b* of the two transporters 30*a* and 30*b*.

Again in this configuration, while keeping the cardboard blank 7*b* in the aforementioned arrangement, the suckers 111 are then lowered, thus placing the front portion 71*b*, as well as a front part of the rear portion 72*b*, against the upper branches 34*a* and 34*b* of the conveyor 3, in order then to deactivate the same suckers 111 (by eliminating their suction), such as to permit gripping and translation in the downstream direction of the cardboard blank 7*b*, by means of the suction conveyors 32*a* and 32*b*, which subsequently release the said upstream portion 3*a* of the conveyor 3 from the cardboard blank 7*b* which has just been transferred, as was previously the case for the cardboard blank 7*a*, in order to be able to receive the new cardboard blank 7*c*.

Again in this configuration, FIG. 8, the orbiting gripper unit 200 has assumed the position of the orbiting gripper unit 100 illustrated in FIG. 2, and the said orbiting gripper unit 200 begins an operative cycle which is identical to that previously described for the orbiting gripper unit 100.

With reference to the preceding description, the collector-translator described and illustrated by way of example has two opposite orbiting gripper units 100 and 200, but, in this context, it is apparent that it is possible to produce.

What is claimed is:

1. An apparatus for transferring a succession of cardboard blanks, comprising:

a store of cardboard blanks having an endless store belt inclined to a horizontal downwardly to a discharge end, and guides for supporting a plurality of cardboard blanks in an upright orientation and presenting said blanks in succession at said discharge end;

a collector-receiver located at said discharge end and comprising:

a horizontal shaft, a pair of horizontally spaced rotary elements keyed to said shaft and rotatable therewith, a plurality of orbiting gripper units carried by said elements and each including:

a gripper shaft rotatable relative to said rotary elements, a plurality of axially spaced radially extending sucker arms on said gripper shaft, a respective sucker at an end of each sucker arm, and a cam-follower arrangement connected to each of said gripper shafts for positioning the suckers of each gripper unit to seize an upright blank presented at said discharge end and rotate a seized blank into a horizontal orientation; and a receiver conveyor having a plurality of horizontal belts for receiving the blanks from said gripper units and positioned so that said gripper units sweep between and alongside said horizontal belts in orbiting path of said gripper units.

2. A system for transferring cardboard blanks in individual succession, in a plant comprising:

a store for collection of cardboard blanks extending longitudinally along a longitudinal axis and presenting at a downstream end cardboard blanks to be transferred;

a conveyor extending longitudinally along a longitudinal axis aligned with the axis of the store for receiving the cardboard blanks;

a rotary collector-translator rotatable about an axis of rotation perpendicular to the axes of the store and of the conveyor, and disposed between a downstream end of said store and said conveyor, and comprising at least one gripper unit comprising at least one sucker for collecting the cardboard blanks in succession from the downstream end of the store and translating the blanks to and releasing the blanks on said conveyor, said conveyor comprises at least one longitudinal rectilinear suction belt transporter defining at least one longitudinal rectilinear suction transporter plane in which an upstream rectilinear suction portion of said longitudinal rectilinear suction belt transporter extends within a substantially circumferential orbital path of said suckers;

said sucker being controlled to move in a first direction along its orbital path around said axis of said rotary collector-translator;

said sucker having a gripping plane which assumes different orientations moving along said circumferential orbital path; and wherein said sucker moves along said circumferential orbital path and passes in a vicinity of opposite sides of said upstream rectilinear suction portion of said rectilinear suction belt transporter.

3. The system according to claim 2, wherein:

the upstream rectilinear suction portion of the said longitudinal rectilinear suction belt transporter comprises at least two rectilinear suction belts, which are disposed transversely spaced from one another, in order to create an aperture which has a predetermined longitudinal and transverse amplitude;

said sucker is controlled to move in a substantially circumferentially circular orbit disposed around said axis of said collector translator and in a plane which is aligned with said aperture; and in said orbital path, said sucker passes between upstream rectilinear suction portions of said two rectilinear suction belts through said aperture.

4. The system according to claim 2 wherein, when the sucker moves along the substantially circumferential orbital path passes in the vicinity of the opposite sides of said upstream rectilinear suction portion the gripping plane of said sucker is parallel to the said upstream rectilinear suction portion of said rectilinear suction belt transporters.

5. The system according to claim 5 wherein said rotary collector-translator and at least one orbiting gripper unit comprise:

two rotary elements, which are disposed facing, and spaced from one another, and are designed to rotate around the axis of rotation;

at least one orbiting and oscillating shaft supported to be rotated by, and between, the said pair of rotary elements, in the vicinity of radial peripheries thereof, is oriented parallel to said axis of rotation (X2), and orbits along a circular path; and at least one arm which can be inclined in a plane which is perpendicular to the said axis of rotation with one end which is fixed to the said orbiting and oscillating, shaft, and opposite ends supporting the sucker.

6. The system according to claim 5 wherein:

said orbiting and oscillating shaft has keyed onto it a first toothed wheel, a toothed belt is wound around the said first wheel;

said toothed belt is also wound around a second toothed wheel, which is supported to rotate adjacent to the said first toothed wheel, by means of a pin, which is supported such as to project axially by the said rotary element, the second toothed wheel supports integrally the first end of a lever the opposite end of the said lever supports a cam-follower roller in an idle rotary manner, and the cam-follower roller follows the profile of a stationary cam.

7. The system according to claim 6 wherein said. profile of said stationary cam has a section which is designed to oscillate the arms of the sucker in a direction opposite a direction in which the said collector-translator is rotated, in order to create a halt, during which contact is made with a cardboard blank which is then grasped and extracted from the store.

8. The system according to claim 6 wherein said profile of the stationary cam has a section which is designed to oscillate the arm of the sucker in a direction opposite a direction in which the said collector-translator is rotated, in order to translate the cardboard blank towards a center of rotation, after it has been extracted, while keeping it parallel to the cardboard blank which is disposed in the vicinity of the downstream end of the store.

9. The system according to claim 6 wherein said profile of the stationary cam has a section which is designed to oscillate the arms of a sucker, such that the gripping plane of the said sucker is parallel to the upstream rectilinear suction portion of said rectilinear suction belt transporters when the said sucker pass as in the vicinity of the said upstream portion.

10. The system according to claim 2 wherein said store can be raised and lowered vertically relative to the axis of rotation of the rotary collector-translator, in order, with cardboard blanks which have different longitudinal extensions, to obtain a gripping area for the sucker which has a substantially equal portion of cardboard blank disposed to the front of the said point.

11. The system according to claim 2 wherein said rotary collector-translator comprises, two orbiting gripper units which are disposed in an opposing manner.

12. The system according to claim 2 wherein said rotary collector-translator comprises a plurality of orbiting gripper units which are disposed in a circumferentially equally spaced manner.

13. The system according to claim 2 wherein a plurality of suckers are provided on arms which have a respective end secured orbiting and oscillating shafts and their respective opposite end each designed to support two suckers.

14. The system according to claim 2 wherein:

a plurality of orbiting gripper units are provided and for each orbiting gripper unit it comprises a first series of suckers which are controlled by means of first pneumatic distribution, and a second series of suckers, which are controlled by means of second pneumatic distribution, said first series of suckers is designed to grasp a first longitudinal portion of the cardboard blank, whereas the said second series of suckers is designed to grasp a second longitudinal portion of the cardboard blank, and along a path of translation of the cardboard blank, there is disposed at least one folding unit, which is designed to execute operations on the said second longitudinal portion of the cardboard blank, during some translation steps, in which the said second series of suckers is non-operative.

* * * * *